United States Patent [19]

Suzuki

[11] Patent Number: 4,730,356

[45] Date of Patent: Mar. 15, 1988

[54] BED HAVING ADJUSTABLE TENSION CONTROL

[76] Inventor: George R. Suzuki, 12861 Wheeler Pl., Santa Ana, Calif. 92705

[21] Appl. No.: 788,119

[22] Filed: Oct. 16, 1985

[51] Int. Cl.[4] ..... A61G 7/00; A47C 3/00

[52] U.S. Cl. ..... 5/187; 5/210; 5/446

[58] Field of Search ..... 5/187, 188, 189, 190, 5/191, 211-225 B, 235, 446, 81 C; 297/284, 441, 449

[56] References Cited

U.S. PATENT DOCUMENTS

| | | | |
|---|---|---|---|
| 207,462 | 8/1878 | Valley | 5/187 X |
| 1,187,824 | 6/1916 | Ersin | 5/223 X |
| 1,228,158 | 5/1917 | Yates | 5/220 |
| 3,289,220 | 12/1966 | Grimshaw | 5/211 X |
| 3,346,891 | 10/1967 | Cundiff | 5/220 |
| 4,297,753 | 11/1981 | Langren | 5/81 C |
| 4,547,918 | 10/1985 | Ginpil et al. | 5/446 |
| 4,592,126 | 6/1986 | Bottemiller | 297/441 X |

FOREIGN PATENT DOCUMENTS

| | | | |
|---|---|---|---|
| 285173 | 2/1928 | United Kingdom | 5/190 |

*Primary Examiner*—William F. Pate, III
*Assistant Examiner*—Richard E. Chilcot, Jr.
*Attorney, Agent, or Firm*—Leonard Tachner

[57] ABSTRACT

A novel bed having a horizontal support frame affixed to a plurality of vertical legs and providing a stretchable mat made of a porous support surface which may be subjected to selected tension by a plurality of springs and spring adjustment bars whereby to selectively adjust the sag resistance of the support surface to the user's various body portions. The stretchable mat of the present invention is readily removed for washing and reinstalled by simply releasing the tension on the springs. The stretchable mat is of a porous nature which allows the body surfaces in contact with the mat to "breathe" and which also allows liquids to pass through the mat whereby to provide a means for avoiding unnecessary discomfort to an incontinent user or patient. One of the principal advantages of the present invention is the hygienic effect of avoiding the use of a dust producing mattress of conventional configuration which typically uses materials which deteriorate with time and are readily released through the mattress cover to create a dust problem adjacent the bed of the prior art. The bed of the present invention will, unlike the bed of conventional mattress and box spring configuration of the prior art, not sag with time. Any sag produced in the present bed as a result of protracted use can be readily removed by simply readjusting the tension of the springs whereby to always provide a non-sag surface to promote the healthful sleep and rest of the user. An optional lumbar support is also disclosed.

2 Claims, 7 Drawing Figures

BED HAVING ADJUSTABLE TENSION CONTROL

BACKGROUND OF THE INVENTION

1. Field of the Invention

The present invention relates generally to the field of beds and more particularly, to an improved therapeutic bed which is especially advantageous to the user from a standpoint of health and which is designed to provide a relatively thin, horizontal mat that can be adjusted to provide various degrees of tension to promote comfort and therapeutic effects.

2. Prior Art

Most western societies today utilize beds which comprise a relatively thick mattress and a box spring supported by a substantially rectangular frame. Such bed configurations are particularly commonplace in the United States despite the advent in recent years of the water bed which is used by a small minority as a substitute for a conventional mattress and box spring. Such conventional bed configurations suffer a number of disadvantages. By way of example, typically such beds provide no means for adjusting individual portions of the surface to have varying degrees of tension to provide the greatest degree of comfort for various parts of the human body. Furthermore, such conventional beds tend to begin to sag within a relatively short time thereby reducing the comfort that the bed provided in its new condition and such sagging increases with the life of the bed thereby causing increasing degrees of discomfort often causing or at least exacerbating back problems experienced by a great many people nowadays. As much as eighty percent of the United States adult population has or has had back problems. Furthermore, with aging, a typical mattress tends to produce increasing amounts of dust resulting from disintegration of the material comprising the mattress such as foam rubber and other materials which gradually decay into a particulate-like material which readily escapes through the mattress cover. Furthermore, conventional mattresses used both in the home and hospitals do not normally allow air to reach the body surfaces that are in contact with the mattress surface. This problem which could for example, increase the incidence of detrimental perspiration during extended hours of sleeping, is particularly disadvantageous in hospitals for patients who must spend protracted periods of time in a hospital bed and who for one reason or another may be unable to vary their positions within the bed without help from nurses and other hospital personnel. Finally, prior art conventional beds do not provide any special form of lumbar support and therefore even when conventional mattresses are relatively new and have not yet begun to sag, such mattresses do not prevent strain on the lower back when the user is positioned flat on his back in a typical manner.

Accordingly, there has been a long-felt need for an improved bed which overcomes the aforementioned deficiencies of conventional beds. More specifically, there has been a longfelt need for a bed which provides proper support for the whole body and which includes a surface designed to come in contact with the body which is adjustable to provide varying degrees of tension whereby to control comfort levels for different parts of the body depending upon weight distribution and anatomy. Furthermore, the present invention solves the long-felt need for a bed support surface which does not create dust and dirt by the disintegration of materials commonly found in conventional mattresses. Furthermore, the present invention solves a long-felt need for a bed support surface which is transmissive to air thereby allowing air to reach surfaces of the body that are in contact with the underlying bed support surface. Furthermore, the present invention solves a long-felt need for a bed support surface which is waterproof and therefore can be used in hospitals for example, for patients who are incontinent. Finally, the present invention solves a long-felt need for lumbar support by providing an optional lumbar area support spring which can be readily added to the improved bed of the present invention to provide optional lower back support for those who wish to further decrease back strain that would otherwise occur when they lie flat on their back.

SUMMARY OF THE INVENTION

The aforementioned long-felt needs for an improved bed are served in the present invention which comprises an improved bed that is especially advantageous from a therapeutic standpoint. One illustrative embodiment of the present invention comprises a substantially rectangular tubular frame in which the main support surface comprises a relatively thin mat made of vinyl-covered polyester cord. The mat is in a substantially rectangular shape but has four flaps which are designed to bend vertically around the rectangular frame. Each of those flaps is provided with a plurality of grommet holes designed to receive the hook end of a like plurality of springs. The end of each spring opposite the hook end is connected to a horizontal bar which is positioned on the side of the bed and which is adjustable for varying the tension of the springs. A typical bed of the present invention adapted to used by one person, has dimensions of 7 feet in length and 3 feet in width. There are for example, twenty five grommets and hooks and three bars that are adjustable for varying the tension of the springs along the 7 foot length side of the bed and a commensurate number of hooks, bars and springs on the 3 foot side of the bed. The rectangular mat is surrounded by a rubberized plastic material having a rayon interior which is heat bonded to the mat to provide a strong perimeter for overlapping the frame of the bed and providing the grommets. The frame of the bed adjacent the mat perimeter is provided in one embodiment with a plurality of rotatable plastic tubes to permit the tension of the mat to be adjusted more readily as will be hereinafter more fully described.

The result is an improved therapeutic bed which is particularly advantageous from the standpoint of body comfort and dirt and dust prevention. The mat is waterproof so that it can be used with incontinent patients in hospitals and homes. The material is transmissive to air so that the body can breathe and the bed finds particular advantageous applications in the medical, chiropractic and massage fields. One optional feature of the present invention, which is provided for people having lower back problems, is a special lumbar support which can be advantageously added to the bed immediately beneath the mat at the approximate location of the lower back. The lumbar support comprises one or more non-sag springs double bowed and covered with the same material with which the mat is made whereby to be installed immediately beneath the mat and apply upwardly directed force to the mat beneath the user's back as will be hereinafter more fully described.

OBJECTS OF THE INVENTION

It is therefore a principal object of the present invention to provide an improved bed to entirely overcome or at least substantially reduce the noted disadvantages of the prior art.

It is an additional object of the present invention to provide an improved bed comprising means for adjusting the tension of the supporting surface of the bed whereby said tension can be varied over different parts of the supporting surface to optimize the comfort of the user.

It is still an additional object of the present invention to provide an improved therapeutic bed which is designed to properly support the entire body; which provides individually controlled tension variation for various parts of the body such as the legs, head and trunk individually; which utilizes a flexible, stretchable mat which is waterproof and which can be readily removed, washed and reinstalled on the bed and which is porous to air thereby providing means for transmitting oxygen to the body surfaces which come in contact with the underlying support structure.

It is an additional object of the present invention to provide an improved therapeutic bed which can always be adjusted in tension so that is never sags irrespective of its age.

It is an additional object of the present invention to provide an improved therapeutic bed which includes a novel lumbar support structure which may be optionally added to the bed in the area thereof adapted to support the lower back of the user whereby to minimize strain on the lower back and wherein such lower back support structure is adjustable to accommodate variations in the shape of the respective backs of the users.

BRIEF DESCRIPTION OF THE DRAWINGS

The aforementioned objects and advantages of the present invention as well as additional objects and advantages thereof will be more fully understood hereinafter as a result of a detailed description of a preferred embodiment when taken in conjunction with the following drawings in which.

DETAILED DESCRIPTION OF A PREFERRED EMBODIMENT

Figure 1:
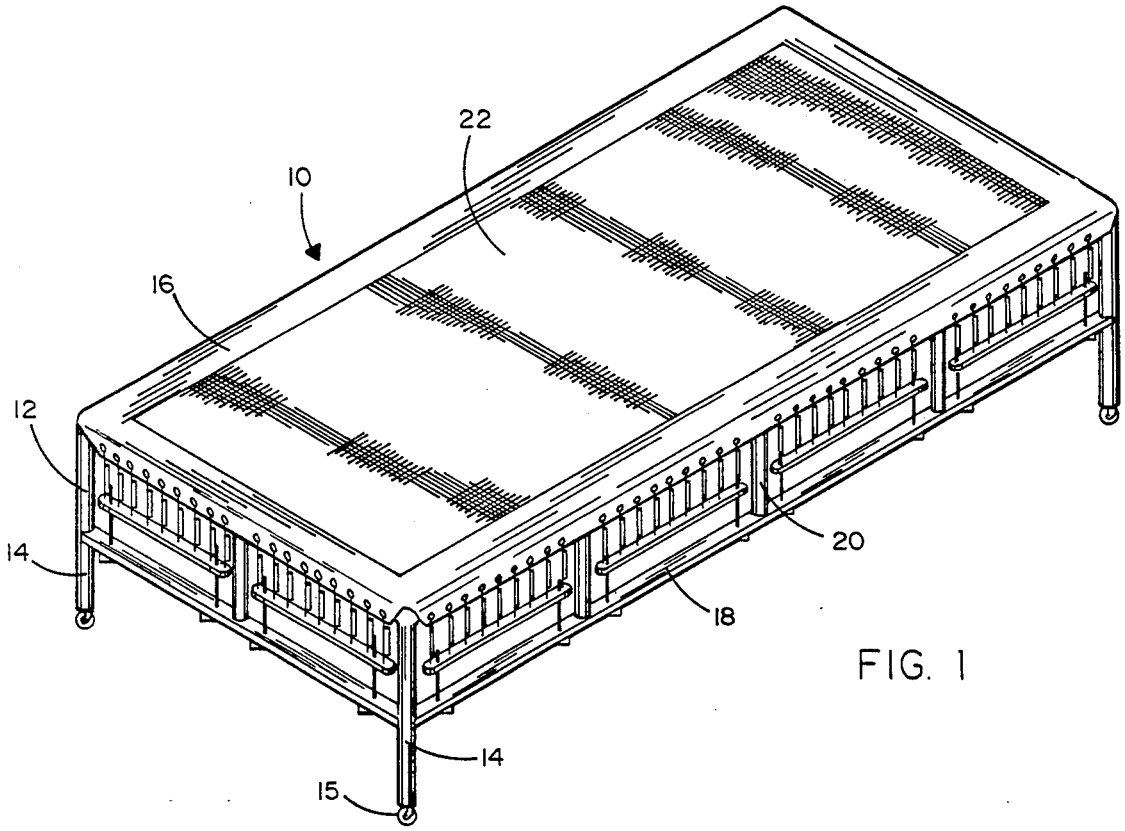
FIG. 1 is a three dimensional view of the improved bed of the present invention.

Referring now to FIG. 1 it will be seen that the improved bed 10 of the present invention comprises a bed frame 12 having a generally rectangular horizontal support frame 16 supported by a set of vertical legs 14 and optional rollers 15. Bed 10 also comprises a set of tension support bars 18 which interconnect the vertical legs 14 in spaced parallel relation to the horizontal support frame 16 and are spaced from the frame by a plurality of vertical members 20.

Figure 2:
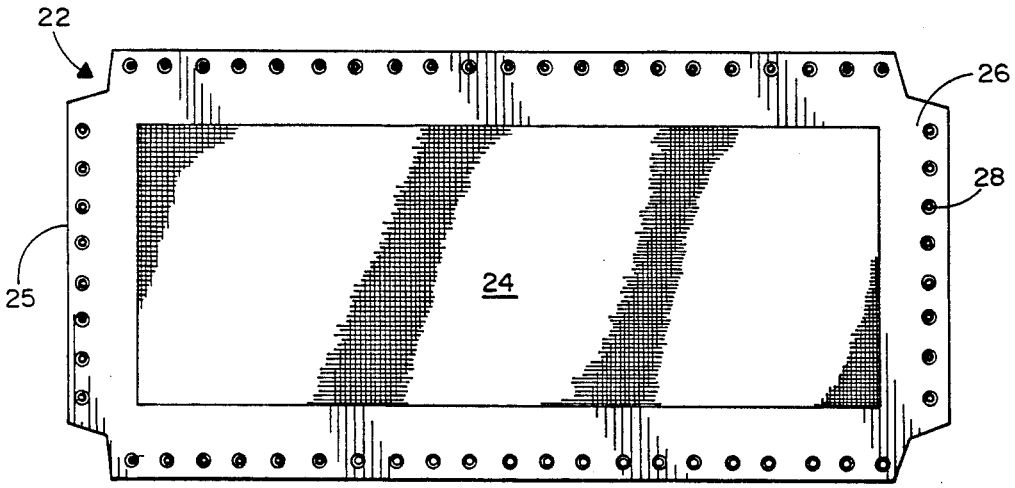
FIG. 2 is a top view of the stretchable mat used in the present invention.

The user support surface of the bed 10 is provided in the form of a stretchable mat 22 which as seen best in FIG. 2, comprises a porous support surface 24 of generally rectangular configuration and permanently affixed along its entire border to a rubberized plastic material 26. The rubberized plastic material 26 is shaped to provide a plurality of foldable flaps 25 each such flap having a plurality of equally spaced grommet holes 28 along the outer periphery thereof the purpose of which will be seen hereinafter. The porous support surface 24 is preferably made of a vinyl covered polyester cord material which has a knitted or interlaced appearance making it relatively porous to both liquids and gases. This material has been found particularly advantageous for use in the present invention because of its beneficial features mentioned previously. More specifically, the porous support surface 24 allows air to reach the body of the user lying on the bed. In addition, it is relatively waterproof and allows incontinent users to continue to sleep comfortably despite urinating in their sleep. In addition, the material has a therapeutic massaging effect on the surfaces of the skin, all of which tend to make the material especially advantageous for use in hospitals for bedridden patients.

Figure 4:
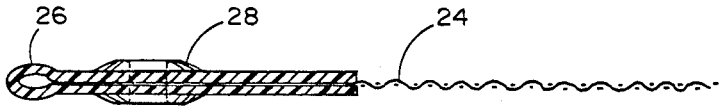
FIG. 4 is a partial cross-section view of the mat of the present invention illustrating the manner in which the mat is constructed.

The manner in which the porous support surface 24 and the rubberized plastic material 26 are interconnected is shown in FIG. 4. As seen in FIG. 4, the rubberized plastic material is provided with two layers of material which receive the porous support surface 24 therebetween. The interfacing surface of the rubberized plastic material 26 is woven rayon and polyester and the sandwiched structure is formed by the two rayon and polyester layers and the porous support surface 24 which are joined and heat treated to provide a strong secure bond therebetween.

Figure 3:
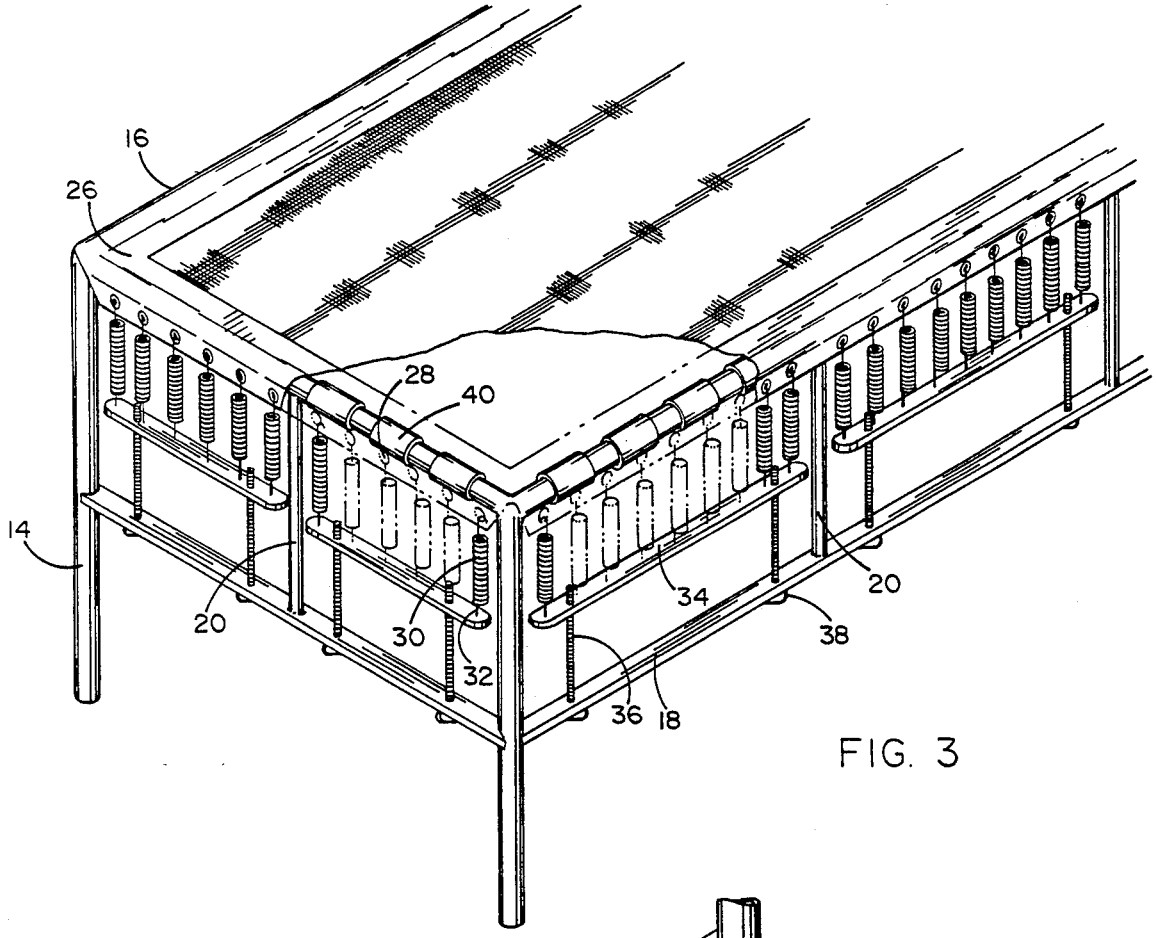
FIG. 3 is an enlarged three dimensional view of a portion of the bed of the present invention showing the details of the construction thereof.

The detailed structure of the present invention may be best understood by reference to FIG. 3 wherein it is shown that the foldable flaps 25 of the stretchable mat 22 are folded over the horizontal support frame 16 whereby to position the grommets 28 over the sides of the bed 10 between the horizontal support frame 16 and the tension support bars 18. As seen further in FIG. 3, the horizontal support frame 16 is provided with a plurality of loose fitting plastic tubes 40 which are adapted for rotation to decrease the resistance of the stretchable mat 22 to the application of tension as hereinafter described.

The stretchable mat 22 is interconnected to a plurality of spring adjustment bars 34 by a plurality of springs 30, each of which comprises a hook end member 32. One such hook is designed to be threaded through a grommet hole 28 and the other hook of each spring is designed to be threaded through a corresponding hole in the spring adjustment bar 34. The spring adjustment bar is, in turn, interconnected to the tension support bar by a pair of bolts 36, each of which is provided with a wing nut 38 below the tension support bar 18. It will be seen therefore that when the wing nuts 38 are appropriately tightened, the tension applied to the springs 30 may be adjusted whereby to apply selected tension to the various portions of the stretchable mat 22. There are a total of two spring adjustment bars 34 at each end of the horizontal support frame 16 and a total of four such spring adjustment bars on each elongated side of the horizontal support frame 16. In the particular embodiment disclosed herein the overall dimensions of the bed 10 are 7 feet long and 3 feet wide. The smaller dimension is divided in half by a unitary vertical member 20 and the longer dimension of the bed is divided in fourths by three such vertical members 20. One spring adjustment bar 34 is provided between each pair of vertical members 20 and between each vertical member 20 and each vertical leg 14. Furthermore, the distance between the horizontal support frame 16 and the tension support bars 18 is approximately 8 inches in the particular preferred embodiment illustrated herein. The length of the springs 30 including hooks 32 is approximately 3½ inches in their non-expanded or relaxed configuration and typically on the order of 4 to 5 inches when the wing nuts 38 are tightened to provide the tension to the springs and to the stretchable mat 22 as hereinabove described.

Figure 5:
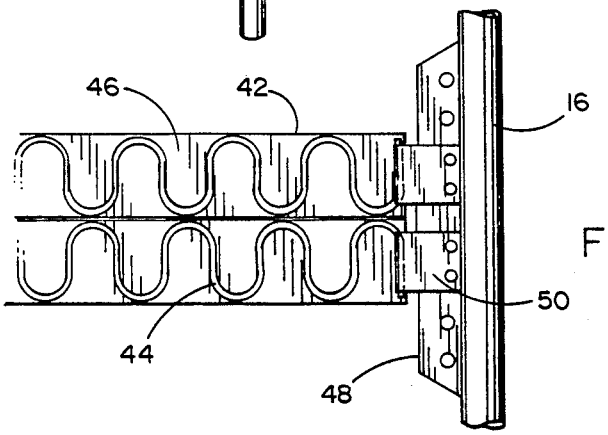
FIG. 5 is a top view of a lumbar support structure that may be optionally used in conjunction with the present invention.
Figure 6:
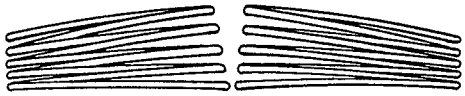
FIG. 6 is an end view of the spring used in the lumbar support of FIG. 5.
Figure 7:
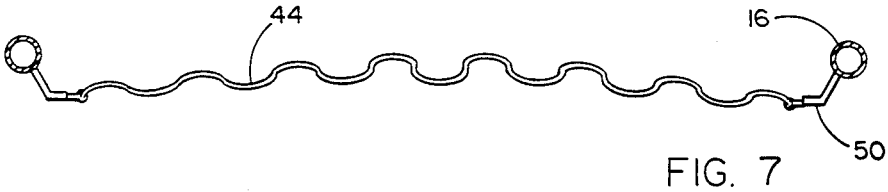
FIG. 7 is a side view of the spring used in the lumbar support of FIG. 5.

As previously indicated the present invention is provided with an optional additional feature comprising a lumbar support 42 shown in FIGS. 5, 6 and 7. As seen in those figures the lumbar support 42 comprises a pair of non-sag substantially horizontal S-shaped springs 44 which are sold under the trademark "KENTZAG" by the Atlas Spring Manufacturing Company of Gardena, Calif. Each of these springs 44 is enclosed within a cover 46 which is preferably made of the same vinyl covered polyester cord material that the porous support surface 24 of stretchable mat 22 is made from. The lumbar support 42 is connected to the horizontal support frame 16 by means of a bracket 48 which is welded to the horizontal support frame and which is provided with a plurality of holes for receiving a pair of brackets 50 to which the ends of respective springs are connected on each elongated side of the bed at a location designed to support the lumbar area of the user of the bed 10.

As shown best in FIGS. 6 and 7, the lumbar support 42 is designed to provide a support surface which is shaped to conform to the lower back of the user. More specifically, as seen in FIG. 6 which provides an end view of the lumbar support 42, the non-sag springs 44 are each adjusted so that they are higher adjacent the mid-point of the bed 10 than they are at the end points adjacent the horizontal support frame 16. Furthermore, by using two such springs 44 the weight of the user on the lumbar support 42 causes the springs to be depressed along the edges facing the ends of the bed and therefore elevated along the edges between the springs whereby to form a hump-shaped support surface to most closely conform to the user's lumbar area. The elevated or hump-shaped configuration of the lumbar support 42 and the proximity of the lumbar support to the stretchable mat 22, causes the area of the mat 22 immediately above the lumbar support to be also raised and therefore hump-shaped to provide the user with the advantageous support provided by the lumbar support 42. Although the lumbar support 42 is an optional feature of the present invention, it can be seen that it would be highly advantageous to provide such lumbar support for those users who have lower back problems and for whom such additional support would alleviate the strain on the lower back that would otherwise be present in the event the user were to lie on a perfectly flat, horizontal surface.

It will be understood that what has been disclosed herein comprises a novel bed having a horizontal support frame affixed to a plurality of vertical legs and providing a stretchable mat made of a porous support surface which may be subjected to selected tension by a plurality of springs and spring adjustment bars whereby to selectively adjust the sag resistance of the support surface to the user's various body portions. It will be seen that the stretchable mat of the present invention is readily removed for washing and reinstalled by simply releasing the tension on the springs by adjustment of the wing nuts whereby to permit release of the grommet holes 28 from the hooks 32 of the springs 30. The stretchable mat 22 is of a porous nature which allows the body surfaces in contact with the mat to "breathe" and which also allows liquids to pass through the mat whereby to provide a means for avoiding unnecessary discomfort to an incontinent user or patient. In fact, the bed of the present invention may be optionally supplied with a suitable container located beneath the mat 22 for collecting the urine of incontinent patients which passes through the mat because of the mat's advantageously porous configuration. One of the principal advantages of the present invention is the hygienic effect of avoiding the use of a dust producing mattress of conventional configuration which typically uses materials which deteriorate with time and are readily released through the mattress cover to create a dust problem adjacent the bed of the prior art. Perhaps more importantly, the bed of the present invention will, unlike the bed of conventional mattress and box spring configuration of the prior art, not sag with time. Any sag produced in the present bed as a result of protracted use can be readily removed by simply readjusting the tension of the springs whereby to always provide a non-sag surface to promote the healthful sleep and rest of the user.

Those having skill in the art to which the invention pertains will now as a result of the applicant's teaching herein, perceive various modifications and additions to the invention. By way of example, other forms of tension producing devices and configurations will now be perceived and other alternative materials will be contemplated for use in the invention. However, it will be understood that all such modifications and additions are deemed to be within the scope of the present invention which is to be limited only by the claims appended hereto.

I claim:

1. A bed comprising:

a frame;

a stretchable mat; and means connecting said mat to said frame for selective adjustment of the tension applied to said mat whereby to prevent sagging of said mat otherwise resulting from the use of said bed, at least one spring tension bar, said mat having a plurality of grommeted holes along the perimeter thereof, said connecting means comprising a plurality of springs, each said spring being connected at one end to a grommeted hole and connected at a second end to said spring tension bar, each said spring tension bar being adjustably connected in spaced relation to said frame whereby adjustment of said spring tension bar for varying said spaced relation changes said tension applied to said mat, said mat comprising an interleaved mesh of a plurality of vinyl covered polyester cords, and a rubberized plastic material;

a lumbar support affixed to said frame immediately beneath said mat, wherein said lumbar support comprises at least one elongated, substantially planar S-shaped spring configured to protrude into said mat for supporting the lower back region of a user.

2. The bed recited in claim 1 wherein said lumbar support is configured to be higher toward the center of said mat and lower toward the edges of said mat.

* * * * *